United States Patent [19]

Hermanson

[11] Patent Number: 5,009,381

[45] Date of Patent: Apr. 23, 1991

[54] TOOL HOLDER FOR TOOLS ON A PERFORATED BOARD

[75] Inventor: Fredrik Hermanson, Flugeby, Sweden

[73] Assignee: Bengt Henningson, Sweden

[21] Appl. No.: 469,526

[22] PCT Filed: Sep. 13, 1988

[86] PCT No.: PCT/SE88/00471

§ 371 Date: Mar. 13, 1990

§ 102(e) Date: Mar. 13, 1990

[87] PCT Pub. No.: WO89/02347

PCT Pub. Date: Mar. 23, 1989

[30] Foreign Application Priority Data

Sep. 14, 1987 [DE] Fed. Rep. of Germany ..... 8712428
Mar. 14, 1988 [DE] Fed. Rep. of Germany ..... 8803408

[51] Int. Cl.[5] ..... A47B 96/06

[52] U.S. Cl. ..... 248/221.1; 211/59.1; 248/222.1

[58] Field of Search ..... 248/221.1, 222.1, 220.3, 248/220.4, 221.2, 221.3, 223.1, 222.2; 211/59.1

[56] References Cited

U.S. PATENT DOCUMENTS 3,241,799 3/1966 Terlinde ..... 248/222.1 X
3,452,954 7/1969 Lucietto et al. .
3,484,069 12/1969 Larson ..... 248/221.1
3,894,172 6/1975 Einhorn ..... 248/221.2
4,405,110 9/1983 Gibbons ..... 248/221.2
4,441,619 4/1984 Gibitz ..... 248/222.1 X
4,474,351 10/1984 Thalenfeld .
4,512,481 4/1985 Thalenfeld ..... 211/57.1
4,662,592 5/1987 Garfinkle .
4,941,632 7/1990 Couls et al. ..... 248/222.1

FOREIGN PATENT DOCUMENTS 0180836 4/1989 European Pat. Off. ..... 441/576
2838962 1/1981 Fed. Rep. of Germany .
339198 9/1971 Sweden .

*Primary Examiner*—Ramon O. Ramirez
*Attorney, Agent, or Firm*—Davis, Bujold & Streck

[57] ABSTRACT

A holder for tools, on a perforated board, with a plate-like base (1) for retaining a tool carrier (4), the base being provided with a slot (9) extending from a center hole away from a supporting beam (2) and terminating at a bottom perimeter edge of the base. The slot (9) extends through a cutout portion (10), into which is inserted a twistable locking member (11) having a claw (15) on a side of the base opposite a handle (13) for cooperation with a hole in the perforated board. By movement of the locking member along the slot (9), the claw is insertable into a hole of a perforated board and is able to grasp there behind the board to secure the holder in a desired position.

12 Claims, 4 Drawing Sheets

Fig. 8
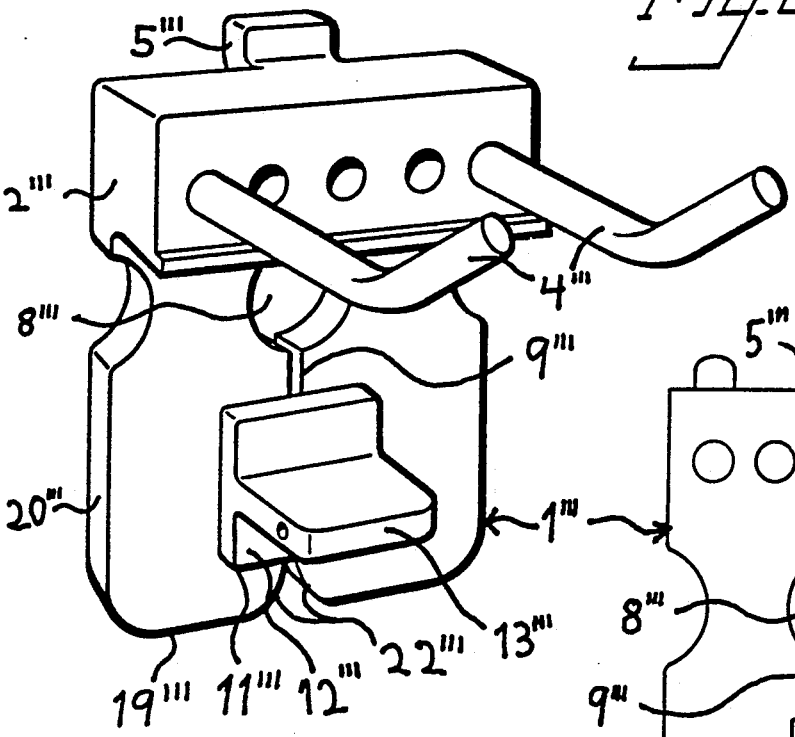
Fig. 9
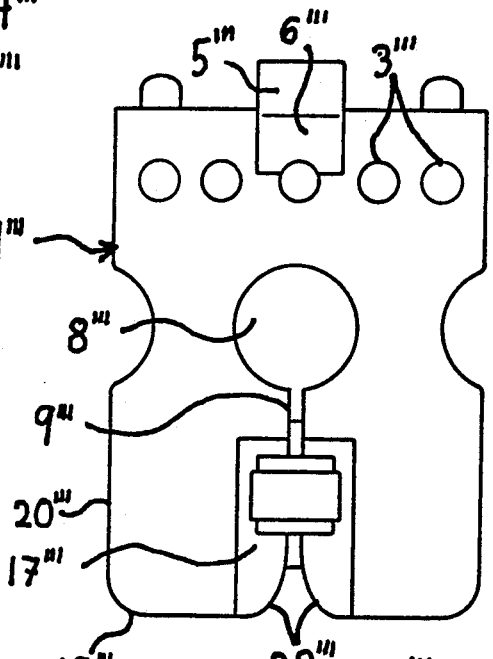
Fig. 10
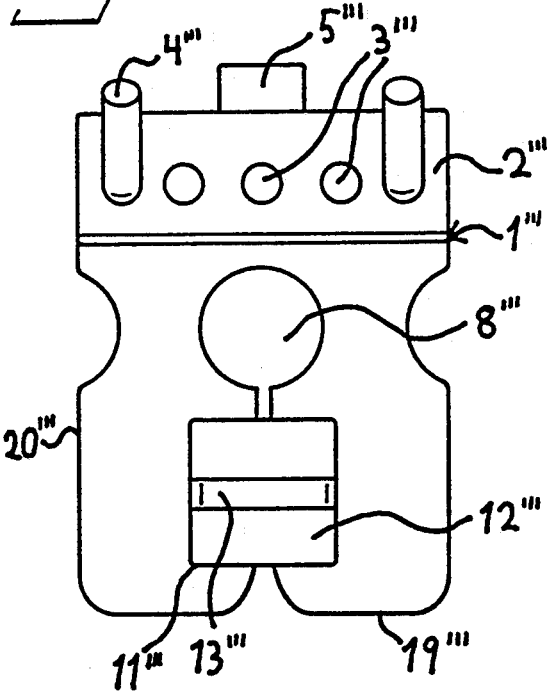
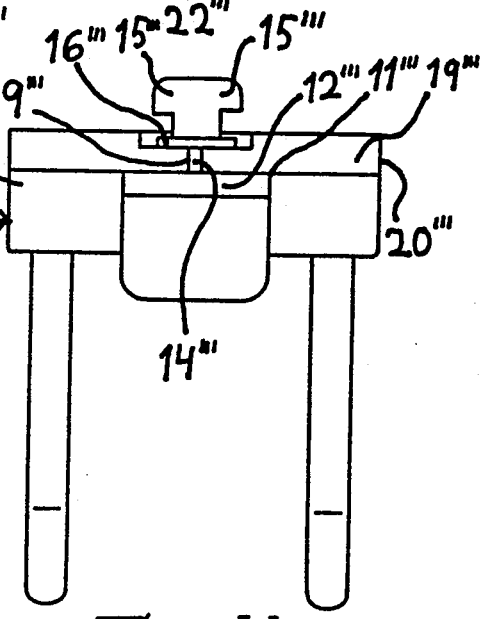
Fig. 11

TOOL HOLDER FOR TOOLS ON A PERFORATED BOARD

Previously known holders of this kind are not able to adapt themselves to different distances between holes, i.e. a differently designed or dimensioned holder is to used for each hole module. Another drawback of known techniques resides in that the holders easily become disengaged when subjected to heavy tools and/or strain of any kind and thus fall off the board with the tool or the like. Finally, further disadvantages are to be seen in expensiveness of the holders in production and use in spite of a limited endurance.

An object of the invention is to counteract these drawbacks and to eliminate them as far as possible. Furthermore, it is an object of the invention to develop techniques in this field.

These objects are achieved according to the present invention by a holder of the kind as initially defined, which is further characterized by the features set forth in the characterizing clause of claim 1. Further characteristics of and advantages with the invention are revealed by the following description with reference to the accompanying drawings showing by example non-limited embodiments.

Figure 1:
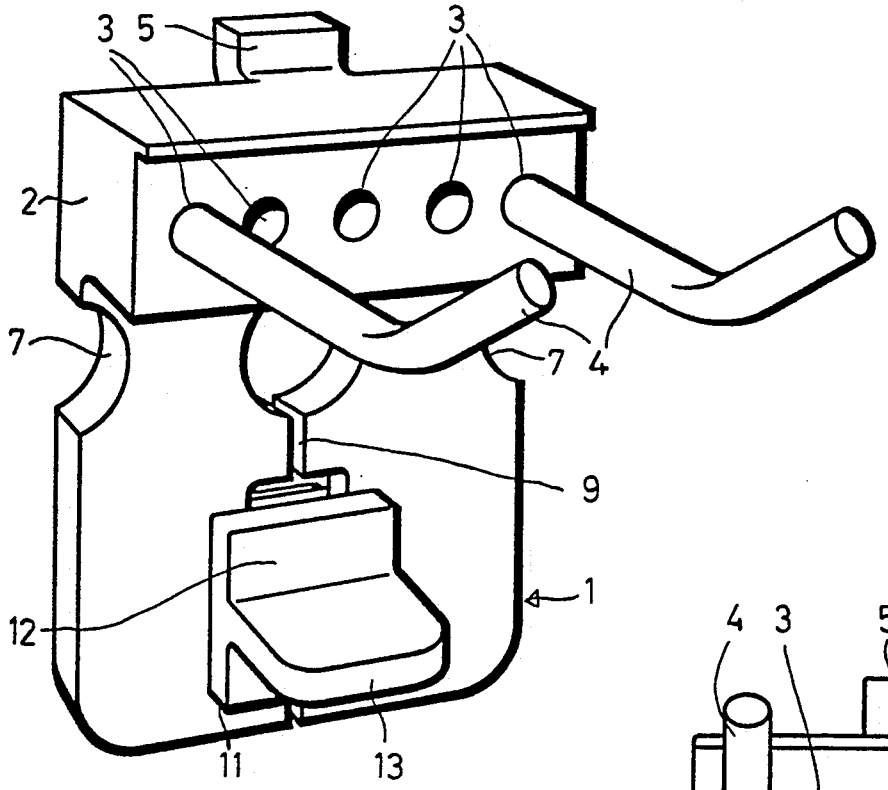
Figure 2:
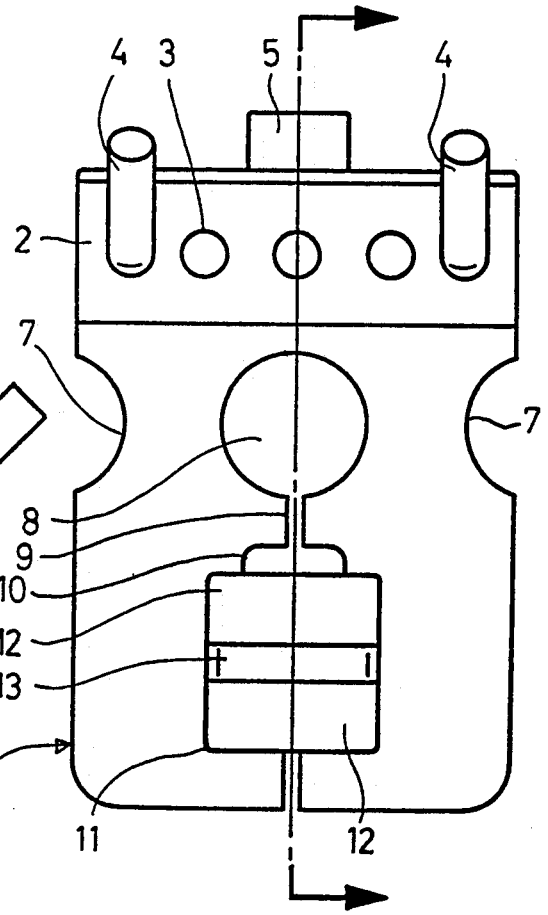
Figure 3:
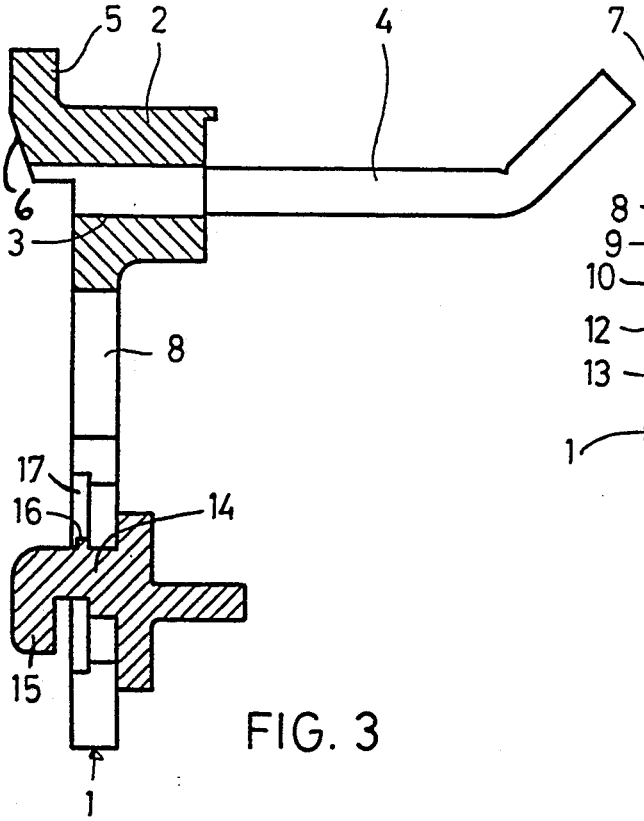
Figure 5:
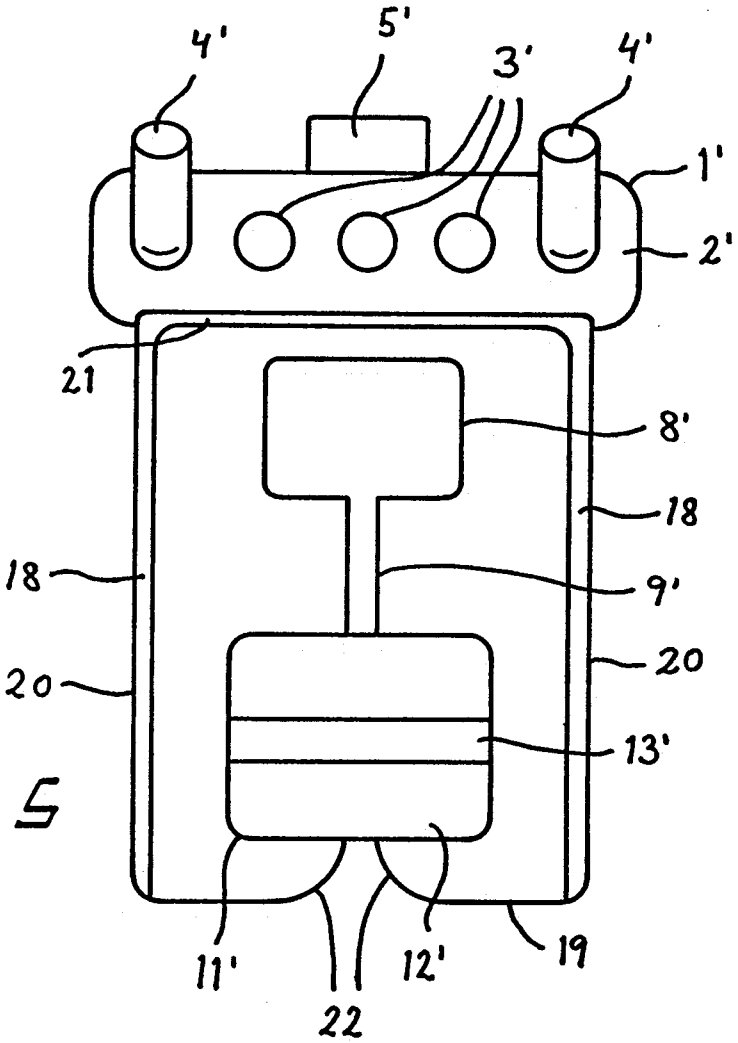
Figure 4:
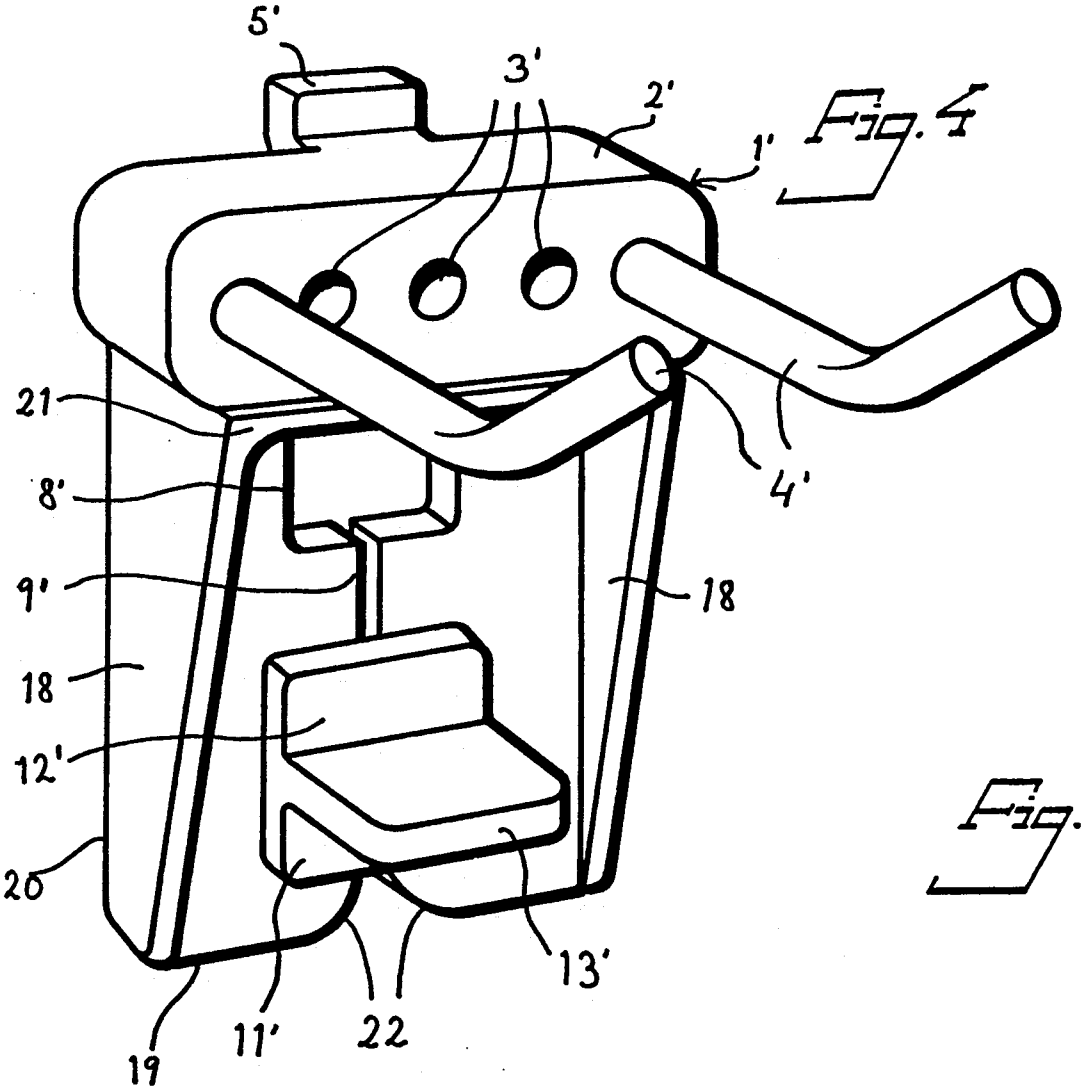
Figure 6:
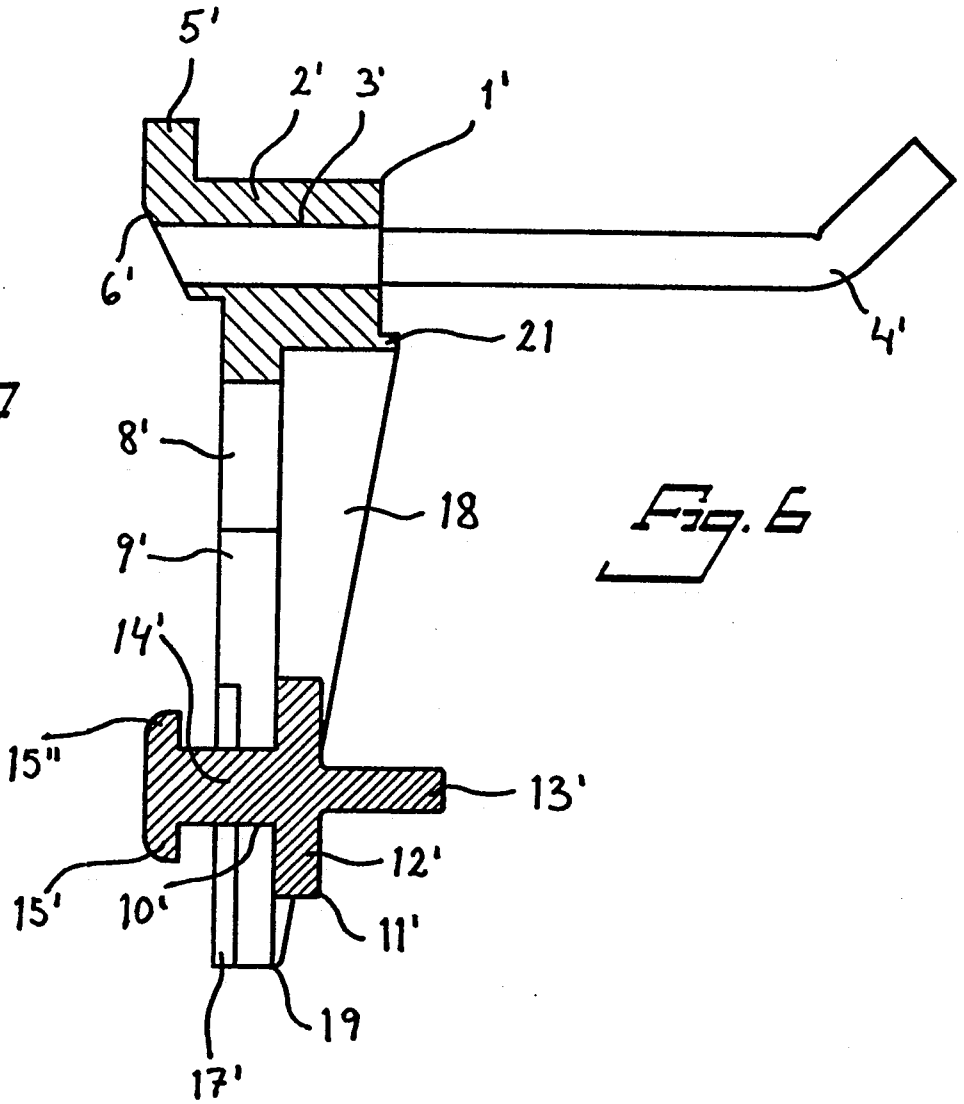
Figure 7:
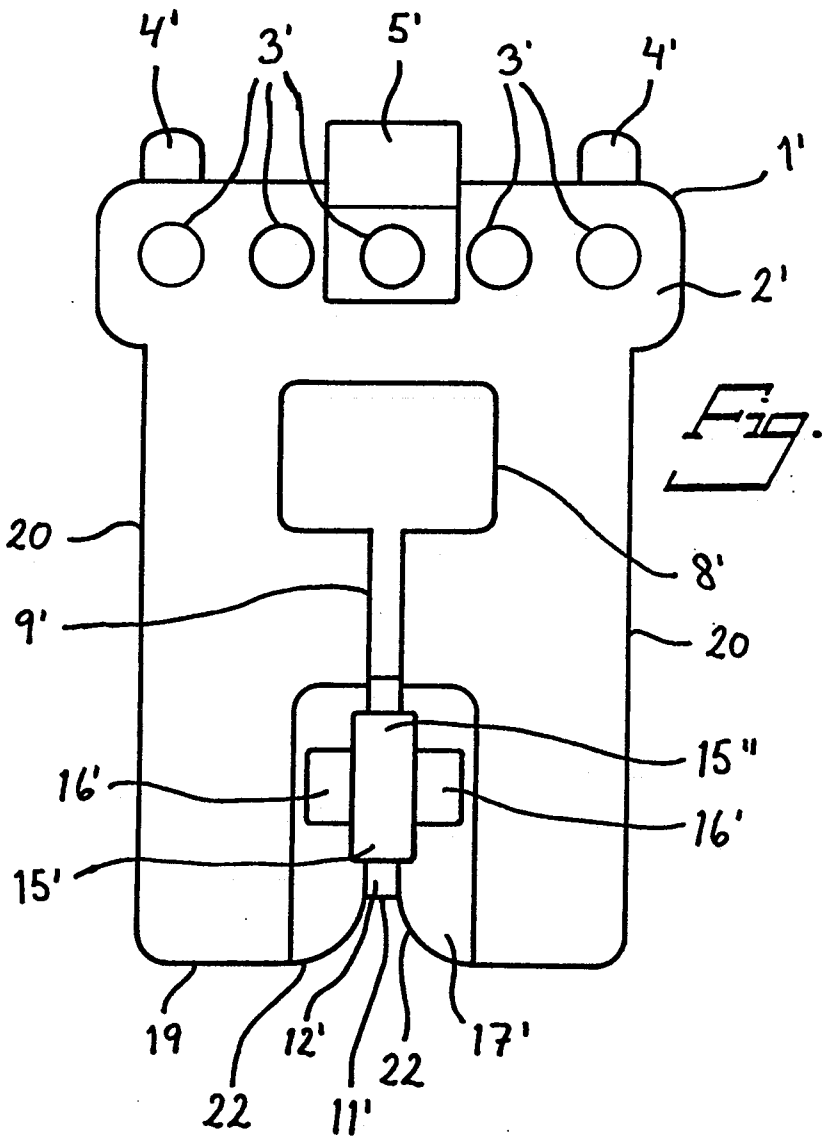

FIG. 1 is a perspective front view from above of a holder according to the invention, FIG. 2 a front view of the holder according to FIG. 1, FIG. 3 is a sectional view according to line III—III in FIG. 2, FIG. 4–6 show a further embodiment according to the present invention corresponding to FIG. 1–3, respectively, FIG. 7 is a rear view of the holder according to FIG. 1–3, and FIG. 8–11 show a third embodiment of a hold according to the present invention in a perspective, rear, front and underneath view, respectively.

The holder according to the invention shows a generally platelike rectangular base 1, which uppermost is thickened to provide a horizontal, traverse supporting beam Z equipped with preferably throughgoing holes 3 arranged at right angle to the base plane and provided to retain tool carriers or the like 4.

In its rear, upper area, the beam 2 is centrally furnished with a rearwardly and upwardly projecting hook 5 having the shape of a parallelepiped. and showing a bevel 6 in its rear lower area.

Below the beam 2, the base is preferably furnished with lateral recesses 7, between which there is centrally provided a circular opening 8. From the latter, there extends downwardly a slot 9, which terminates freely at the lower end of the base while extending through and leaving free an intermediate, roughly rectangular cut-out portion 10. Into this cut-out portion is inserted a locking member 11 abutting the front side of said base with a rectangular plate 12, the front side of which shows a handle 13 designed as a central traverse rib. In said cut out portion said locking member is guided by a guiding part 14, which close to said plate is designed thicker, which then within the rear area of the base is recessed downwardly, and which then forms a guiding flange 16 extending upwardly and laterally within the plane of the base, with which flange said guiding part is guided within an enlargement 17 of base 1 connecting to the cut-out portion 10. Part 14 continues rearwards and beyond base 1 and is terminated by a claw 15, which points downwards.

It will be readily appreciated, that parts 1, 4 and 11 may be manufactured in one piece, respectively. Parts 4 are preferably made of metal, while parts 1 and 11 are made of plastic material, e.g. by injection molding. In this way, a simple and economical mass production is possible. As the holder is made in one piece, except for the locking member, the holder is very rigid and able to resist great strain. Even the locking member is rugged and furthermore utmost protected. The assembly is very simple. The tool carriers or the like 4 may simply be pressed into the base, possibly even screwed in, as the beam 2 is designed with great height and depth, so that any bending is practically impossible even at great strain Furthermore, the beam lends itself to individual shaping, attachments etc. Then, the locking member is introduced into the cut-out portion 10 turned 90°, i.e. with the claw 15 directed laterally, and thereupon, the locking member is twisted within the cut-out portion against the spring action of the bifurcated base to attain a position according to the drawings, wherein the guiding flange grasps behind the enlargement and the member is secured against withdrawal. A vertical movement is, however, possible Now, the hook 5 is introduced into a chosen hole in a perforated board obliquely from below and upwardly and then the holder is pressed against the board, until the claw 15 glides into a fitting lower hole. Thereupon, the locking member is pressed downwards by means of the handle, until the root of the claw 15 rests upon the lower hole wall and thus secures the holder in its entirety. The cut-out portion 10 may have any length, i.e. vertical extension. In this way, it is possible to use the holder for as different distances between holes as for instance 25–40 mm.

The third embodiment according to the present invention as shown in FIG. 8–11 corresponds roughly to the first one. Therefore, same reference numerals have been used for corresponding parts with the addition of "'''". Primarily different is the absence of a cut-out portion 10. The slot 9''' is enlarged lowermost by way of roundings 22'''. The guiding flange 16''' surrounds the locking member 14''' preferably all the way and is guided in an enlargement 17''', which opens downwardly. Finally, instead of one claw, there are provided two claws 15''' and 15'''' pointing in opposite directions. The surfaces of said claws which are facing the holder are preferably arranged in different planes, i.e. at different distances from the holder to compensate for e.g. different depths of perforated boards. The underside is designated with 19''' and the lateral surfaces with 20'''. In the modified embodiment according to FIG. 4–7, same reference numerals with the addition of '''' are used for analogous parts. There are no lateral recesses 7. Instead, there are provided lateral ribs 18 extending from the beam 2' down to the lower edge 19 of holder 1' within the lateral sides 20 of same converging like a wedge from the beam down to the lower edge. The said ribs may be embossed even in relation to the beam and form a ledge 21, which makes a frame together with the ribs. This embodiment is very rigid and resistant to torsion at the same time as the locking member 11' is very much protected.

At its lower, free end, the slot 9' is preferably enlarged by way of roundings 22 for readily inserting the locking member which must, according to this embodiment, not necessarily be moveable along the slot, i.e. apart from the movement of introduction, but preferably is mounted with a rectangular, particularly square guiding part 14' in a commensurate cutout portion 10', through the center of which the slot extends The cutout portion has more than twice the width of the slot, which means that the locking member is to be inserted by elastically bending apart the two halfs of the holder within their plane, whereupon the halfs move towards each other, when the part 14' has snapped into the cut-out portion to secure the locking member in this way.

The locking member 11' shows two guiding flanges 16' extending laterally within the enlargement 17' of the base which is throughgoing down to the lower edge 19 and, at distance from these flanges, two claws 15' and 15'' arranged at right angle in relation to the flanges and pointing in opposite directions, one of which claws is arranged at greater distance from the holder with its side facing same than the other claw to compensate for different depths of perforated boards and possibly other deviations as well. The claws of this latter holder 1' do e.g. attain a horizontal position when inserted in a hole in a perforated board. When now the locking member is twisted 90° against the spring action of both halves of the holder, namely in one direction or in the other, one of the claws grasps behind the lower hole edge and secures the holder.

Universal utility of this embodiment may easily be achieved, e.g. by providing along the slot several cutout portions, which are separated from each other by short bridging parts. In this way, the locking member is pressed into a cutout portion fitting the actual perforated board, which portion accordingly corresponds to space and/or dimensions of the actual holes.

The provision of the insides of the claws in different planes in relation to the holder may also be used for elastically pressing the holder area of the base enlargement against the perforated board and thus secure the holder even safer.

It will be appreciated, that the claws may have other shapes, e.g. even oval shape or the shape an eccentric disc.

I claim:

1. A holder, for supporting a tool on a perforated board, with a bifurcated generally plate-like base (1) for receiving a tool carrier (4), the bifurcation commencing approximately at the center of said base and extending toward a bottom edge thereof, said base having a front surface and a rear surface with the rear surface of said base being provided with claw means (15) for cooperation with a hole of the perforated board, characterized in that the bifurcation is achieved by a slot (9) which extends through a cut-out portion (10), into which is inserted a twistable locking member (11) having said claw means (15), and the locking member (11) is guided in at least one of the cut-out portion (10) and the slot (9) by means of a guiding part (14), shaped to be movable therein, with said claw means projecting from the rear surface of the said base.

2. A holder according to claim 1, characterized in that, said base (1) is rectangular in shape and thickened at its upper end to form a horizontal traverse carrying beam (2), said beam is provided with boreholes (3), which extend at right angle in relation to the plane of said base, for retaining at least one tool carrier (4), and said beam further includes lateral ribs (18) which extend from said beam (2) toward the bottom edge, and the lateral ribs converge toward the bottm edge in a wedge-like manner.

3. A holder according to claim 1, characterized in that an opening (8) is provided in the center of said base from which the slot (9) commences.

4. A holder according to claim 1, characterized in that the locking member (11) comprises a rectangular plate (12) which has a first surface that abuts against the front surface of said base, and the opposite surface of the rectangular plate (12) supports a central traverse handle (13).

5. A holder according to claim 1, characterized in that the guiding part (14), when received by the slot (9), is thicker adjacent the front surface of said base (1) and is thinner adjacent the rear surface of the base, said guiding part forms a guiding flange (16) extending away from the bottom edge and laterally within the plane of said base, the guiding part is guided by the guiding flange engaging an enlargement (17) of said base, formed in the rear surface of said base and connected to the cut-out portion (10), and the guiding part (14) extends beyond the rear surface of said base and carries said claw means (15).

6. A holder according to claim 1, characterized in that the guiding part (14) of the locking member (11) is commensurate to the cut-out portion (10) so as to elastically bend apart both sides of said base upon movement of the guiding part (14) from the cut-out portion (10) along the slot (9).

7. A holder according to claim 1, characterized in that the locking member (11) is longitudinally displaceable within at least one of the cut-out portion (10) and the slot (9) between an insertion position, located remote from the bottom edge, and a locked position, located adjacent the bottom edge, in which said claw means of the locking member engages a hole of the perforated board to secure said holder in place.

8. A holder according to claim 1, characterized in that the locking member has a guiding flange (16) which engages an enlargement (17) formed in the rear surface of said base adjacent the cut-out portion (10).

9. A holder according to claim 1, characterized in that the locking member (11) is insertable into the cut-out portion (10) and the slot (9) by at least one of insertion directly into the cut-out portion (10) and sliding insertion of the locking member into the slot (9) via a rounded opening (22) formed in the bottom edge.

10. A holder according to claim 1, characterized in that said claw means (15) comprises two claws projecting in opposite directions, each claw having a surface facing and the base arranged in a different plane in relation to the base and to each other to compensate for differing thickness of perforated boards.

11. A holder according to claim 1, characterized in that several cut-out portions (10) are provided along the slot (9) and the several cut-out portions are separated by short bridging parts.

12. A holder according to claim 1, characterized in that said base (1) includes hook means (5) on the rear surface of said base, extending away from the bottom edge, for cooperation with a hole of the perforated board.

* * * * *